US012643756B2

(12) United States Patent
Araki et al.

(10) Patent No.: US 12,643,756 B2
(45) Date of Patent: Jun. 2, 2026

(54) MEDIUM SUPPLY DEVICE AND IMAGE FORMING APPARATUS

(71) Applicant: FUJIFILM Business Innovation Corp., Tokyo (JP)

(72) Inventors: Yuichi Araki, Kanagawa (JP); Kazuhiko Horikawa, Kanagawa (JP); Ryosuke Yonesaka, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 548 days.

(21) Appl. No.: 18/157,088

(22) Filed: Jan. 20, 2023

(65) Prior Publication Data

US 2024/0101376 A1 Mar. 28, 2024

(30) Foreign Application Priority Data

Sep. 27, 2022 (JP) ..... 2022-153544

(51) Int. Cl.

| | |
|---|---|
| ***B65H 3/48*** | (2006.01) |
| ***B65H 1/14*** | (2006.01) |
| ***B65H 3/12*** | (2006.01) |
| ***B65H 3/14*** | (2006.01) |
| ***B65H 7/14*** | (2006.01) |

(52) U.S. Cl.

CPC ..... *B65H 7/14* (2013.01); *B65H 3/128* (2013.01); *B65H 3/14* (2013.01); *B65H 2515/60* (2013.01); *B65H 2553/42* (2013.01)

(58) Field of Classification Search

CPC . B65H 3/48; B65H 3/12; B65H 3/128; B65H 2553/42; B65H 2511/528; B65H 2511/524; B65H 7/14; B65H 7/02; B65H 1/14

See application file for complete search history.

(56) References Cited

U.S. PATENT DOCUMENTS

| | | | | |
|---|---|---|---|---|
| 6,182,962 | B1 | 2/2001 | Leuthold | |
| 9,272,863 | B2 * | 3/2016 | Shimoyama | B65H 3/48 |
| 9,340,384 | B2 | 5/2016 | Yabuki et al. | |

FOREIGN PATENT DOCUMENTS

| | | |
|---|---|---|
| JP | 6145793 | 6/2017 |
| JP | 2020152537 | 9/2020 |

OTHER PUBLICATIONS

"Search Report of Europe Counterpart Application", issued on Sep. 18, 2023, pp. 1-8.

* cited by examiner

*Primary Examiner* — Luis A Gonzalez
(74) *Attorney, Agent, or Firm* — JCIPRNET

(57) ABSTRACT

A medium supply device includes: a loading unit on which media are loadable in an up-down direction; a supply unit that supplies air to a plural media loaded on the loading unit to float and separate the plural media; a transporting unit that sequentially feed the media that are floated and separated by the supply unit; a photographing unit that photographs a state in which the media are floated and separated by the supply unit; and a light irradiation unit that irradiates end portions of the media on a photographing side of the photographing unit with light from a plural different positions in the up-down direction.

18 Claims, 13 Drawing Sheets

MEDIUM SUPPLY DEVICE AND IMAGE FORMING APPARATUS

CROSS-REFERENCE TO RELATED APPLICATIONS

This application is based on and claims priority under 35 USC 119 from Japanese Patent Application No. 2022-153544 filed Sep. 27, 2022.

BACKGROUND

(i) Technical Field

The present invention relates to a medium supply device and an image forming apparatus.

(ii) Related Art

In JP6145793B, a sheet supply device including: an arranging unit on which a sheet bundle having a plurality of sheets stacked in an up-down direction is arranged; a blowing unit that blows air toward the sheet bundle arranged on the arranging unit to float the sheet located at an upper layer of the sheet bundle; a sticking/transporting mechanism that is provided above the arranging unit, causes the sheet floated by the blowing unit to stick to the sticking/transporting mechanism, and transports the sheet in a predetermined transport direction; a photographing unit that photographs the sheet floated by the blowing unit; and a lighting unit that irradiates the sheet floated by the blowing unit with light a plurality of times during one exposure in the photographing unit.

SUMMARY

Aspects of non-limiting embodiments of the present disclosure relate to a medium supply device capable of accurately detecting a plurality of media photographed by a photographing unit, compared to a case where media are irradiated with only light from one identical position in an up-down direction, and an image forming apparatus.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a medium supply device including: a loading unit on which media are loadable in an up-down direction; a supply unit that supplies air to a plurality of the media loaded on the loading unit to float and separate the plurality of media; a transporting unit that sequentially feed the media that are floated and separated by the supply unit; a photographing unit that photographs a state in which the media are floated and separated by the supply unit; and a light irradiation unit that irradiates end portions of the media on a photographing side of the photographing unit with light from a plurality of different positions in the up-down direction.

BRIEF DESCRIPTION OF THE DRAWINGS

Exemplary embodiment(s) of the present invention will be described in detail based on the following figures, wherein.

Figure 9:
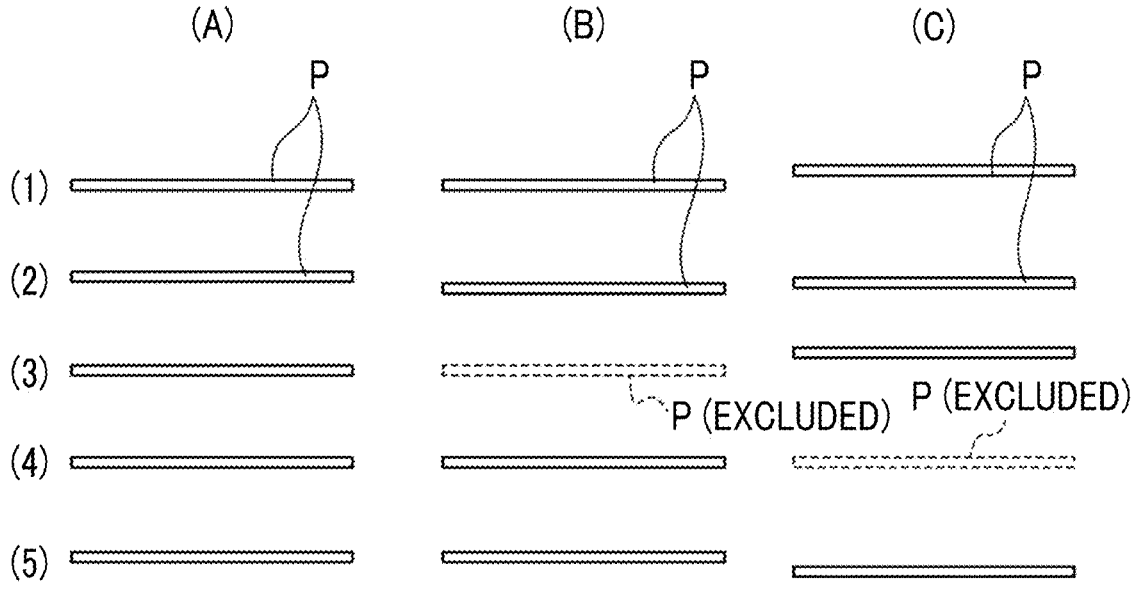
Figure 10:
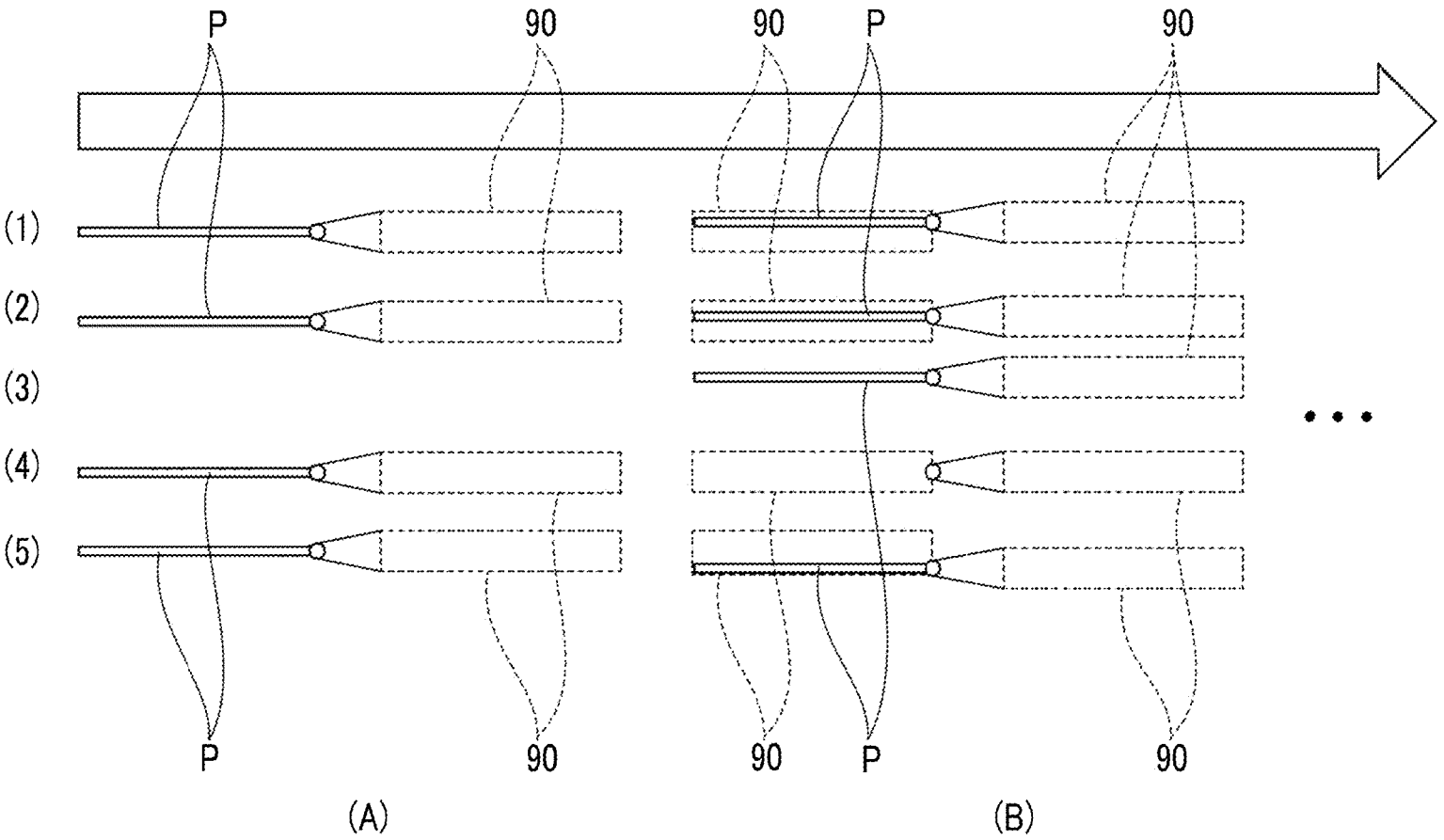
Figure 11:
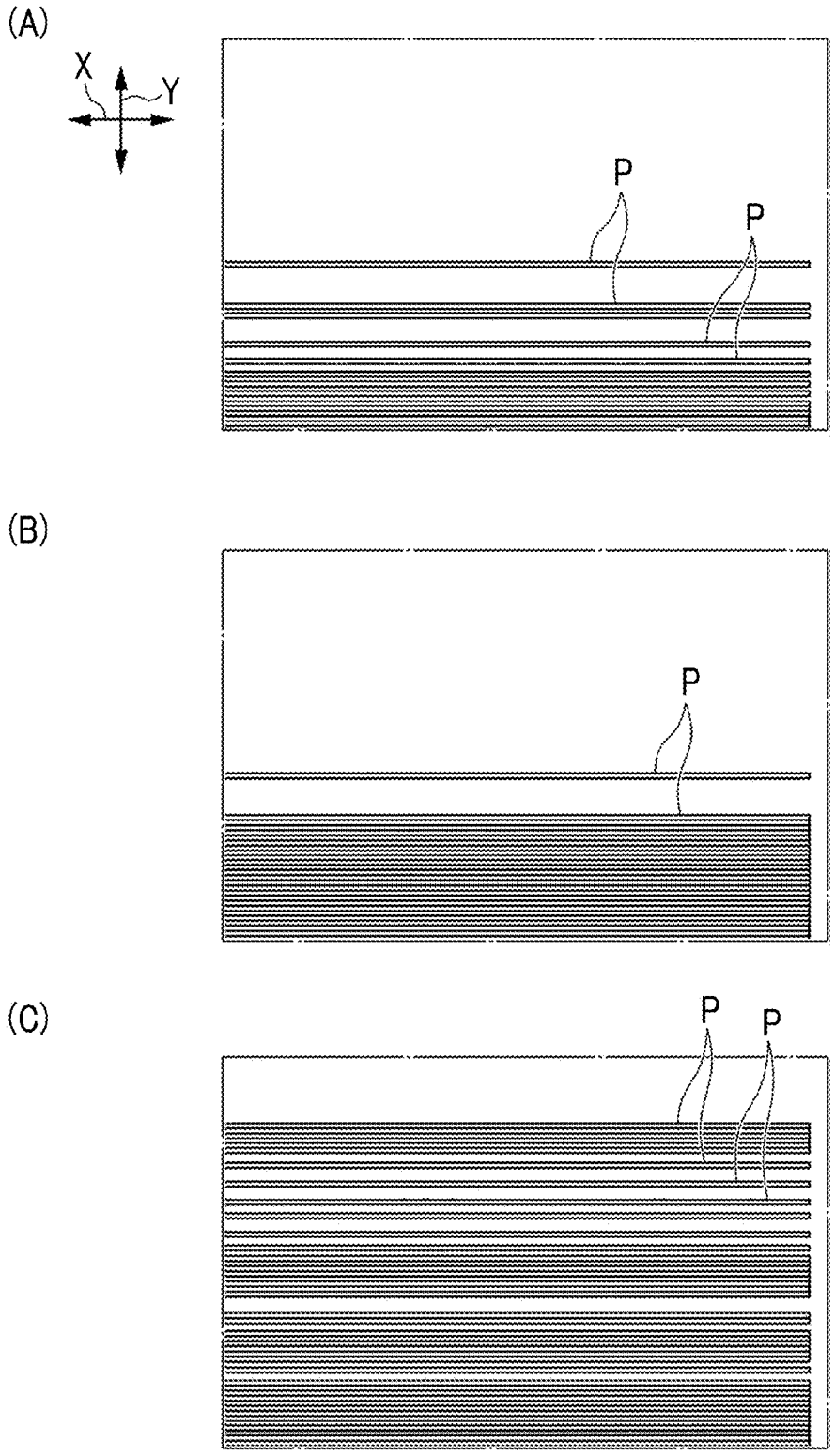
Figure 12:
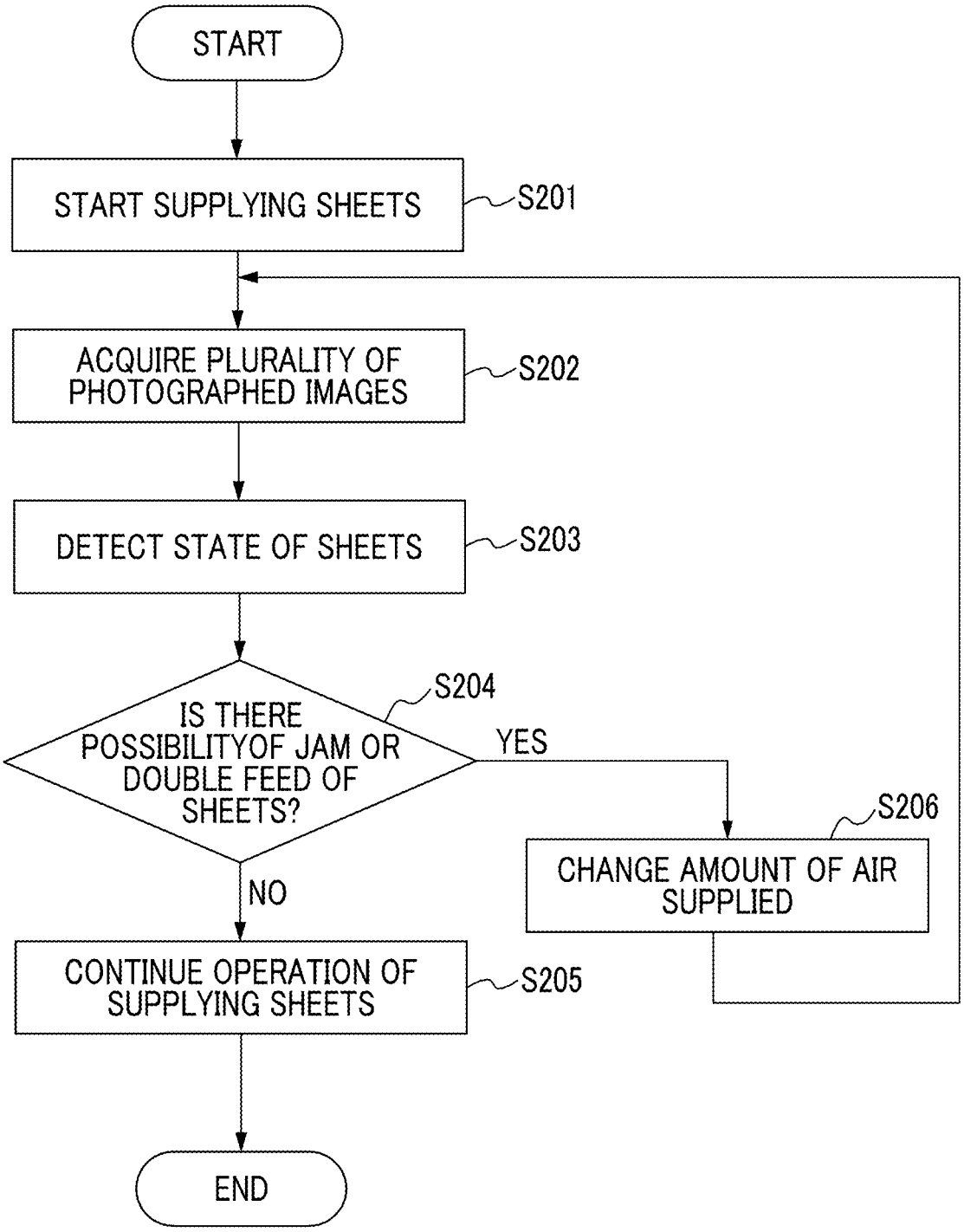
Figure 13:
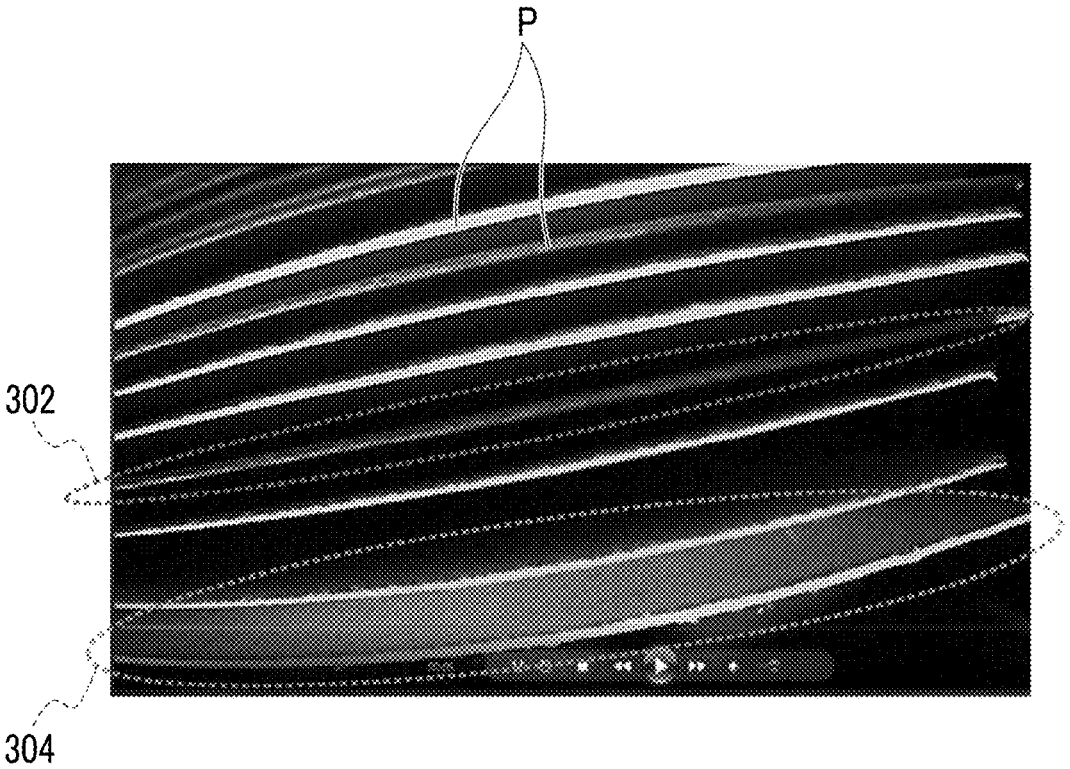

A part (A) in FIG. 9 is a diagram showing actual positions of a plurality of sheets P in the medium supply device according to the first exemplary embodiment, a part (B) in FIG. 9 is a diagram showing an example of an image of a first frame obtained by photographing the plurality of sheets, and a part (C) in FIG. 9 is a diagram showing an example of an image of a second frame obtained by photographing the plurality of sheets;

A part (A) in FIG. 10 is a diagram showing an example in which filters are created based on the image of the first frame, and a part (B) in FIG. 10 is a diagram showing an example in which filters are created based on the image of the second frame;

A part (A) in FIG. 11 is a diagram showing an example of a state in which floating and separation of the sheets are good, a part (B) in FIG. 11 is a diagram showing an example of a state in which the floating and separation of the sheets are insufficient, and a part (C) in FIG. 11 is a diagram showing another example of the state in which the floating and separation of the sheets are insufficient;

FIG. 12 is a flowchart showing a flow of a process of the medium supply device according to the first exemplary embodiment; and FIG. 13 is a view showing a photographed image obtained by photographing end portions of sheets in a medium supply device of a comparative example.

DETAILED DESCRIPTION

Hereinafter, exemplary embodiments for carrying out the present invention will be described. In the following description, a direction indicated by arrow X in the drawings is defined as an apparatus width direction, and a direction indicated by arrow Y is defined as an apparatus height direction. In addition, a direction (arrow Z direction)

orthogonal to each of the apparatus width direction and the apparatus height direction is defined as an apparatus depth direction.

First Exemplary Embodiment

Figure 1A:
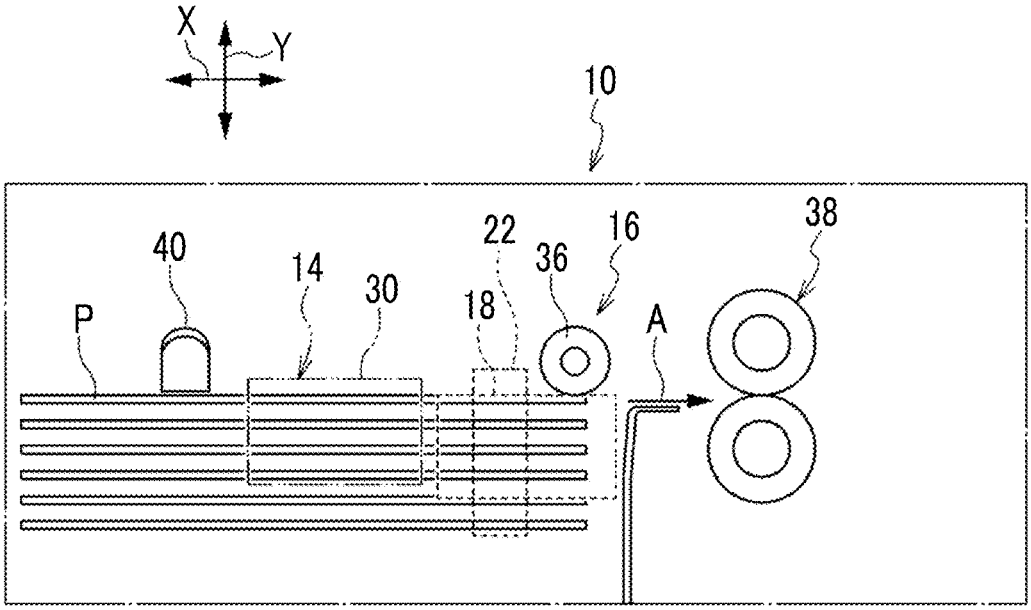
FIG. 1A is a front view showing a part of a medium supply device according to a first exemplary embodiment.
Figure 1B:
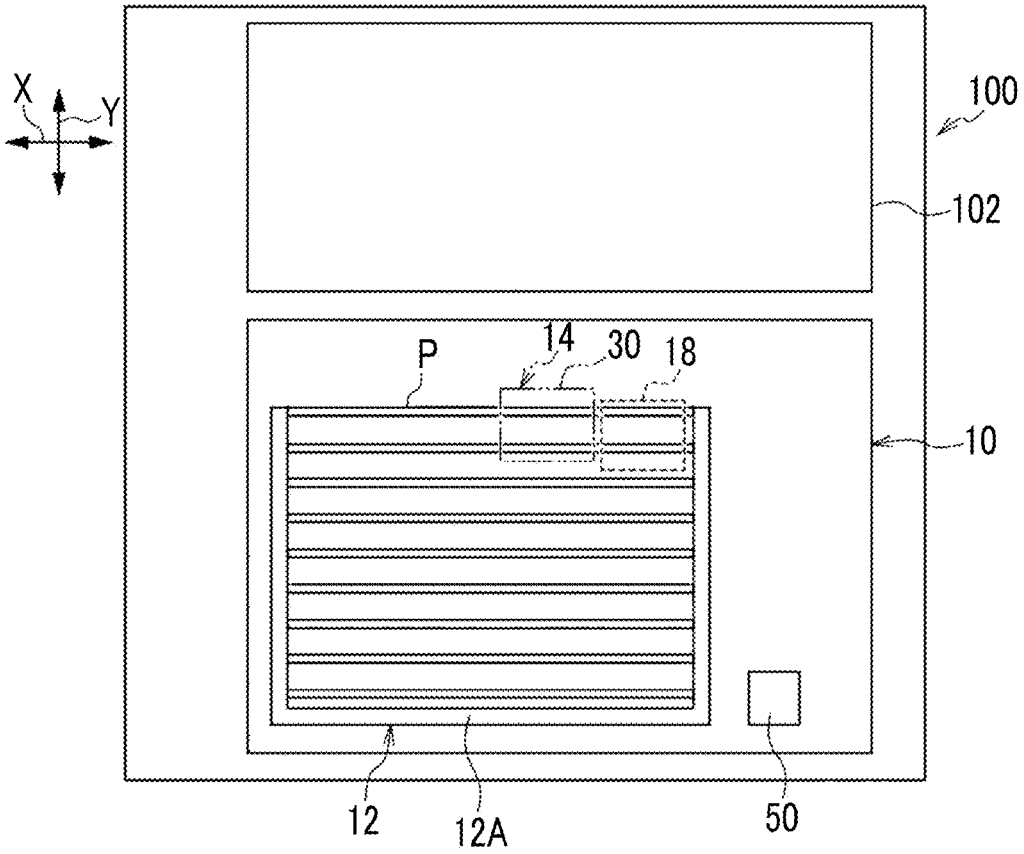
FIG. 1B is a schematic view showing an example of an image forming apparatus including the medium supply device.

FIG. 1A shows a part of a medium supply device 10 according to a first exemplary embodiment, and FIG. 1B shows an example of an image forming apparatus 100 including the medium supply device 10.

Configuration of Image Forming Apparatus

As shown in FIG. 1B, the image forming apparatus 100 includes an image forming unit 102 that forms an image on a sheet P as an example of a medium, and the medium supply device 10 that supplies sheets P to the image forming unit 102 one by one. Although not shown, a transporting unit that transports the sheet P to an image forming position of the image forming unit 102 is provided inside the image forming apparatus 100. A configuration and an arrangement of the image forming unit 102 and the transporting unit are not particularly limited. The medium supply device 10 may also be configured to be attached to an image forming apparatus body as an option.

Configuration of Medium Supply Device

Overall Configuration

As shown in FIGS. 1A and 1B, the medium supply device 10 includes a loading unit 12 on which sheets P can be loaded in an up-down direction and a supply unit 14 that supplies air to a plurality of the sheets P loaded on the loading unit 12 to float and separate the sheets P. In addition, the medium supply device 10 includes a feeding unit 16 that sequentially feeds the sheets P floated and separated by the supply unit 14. The feeding unit 16 is an example of a transporting unit. In addition, the medium supply device 10 includes a camera 18 as an example of a photographing unit that photographs a state in which the sheets P are floated and separated by the supply unit 14, and a light irradiation unit 22 that irradiates end portions of the sheets P on a photographing side of the camera 18 with light. Furthermore, the medium supply device 10 includes a control device 50 that controls an operation of each unit. The control device 50 is an example of a processor.

Loading Unit

As shown in FIG. 1B, the loading unit 12 includes a plate-shaped body 12A on which the plurality of sheets P can be loaded. Although not shown, the medium supply device 10 includes an elevating device that raises and lowers the plate-shaped body 12A in the up-down direction. The elevating device raises the plate-shaped body 12A so that a position of an uppermost sheet P of the sheets P loaded on an upper side of the plate-shaped body 12A reaches a predetermined height.

Figure 2:
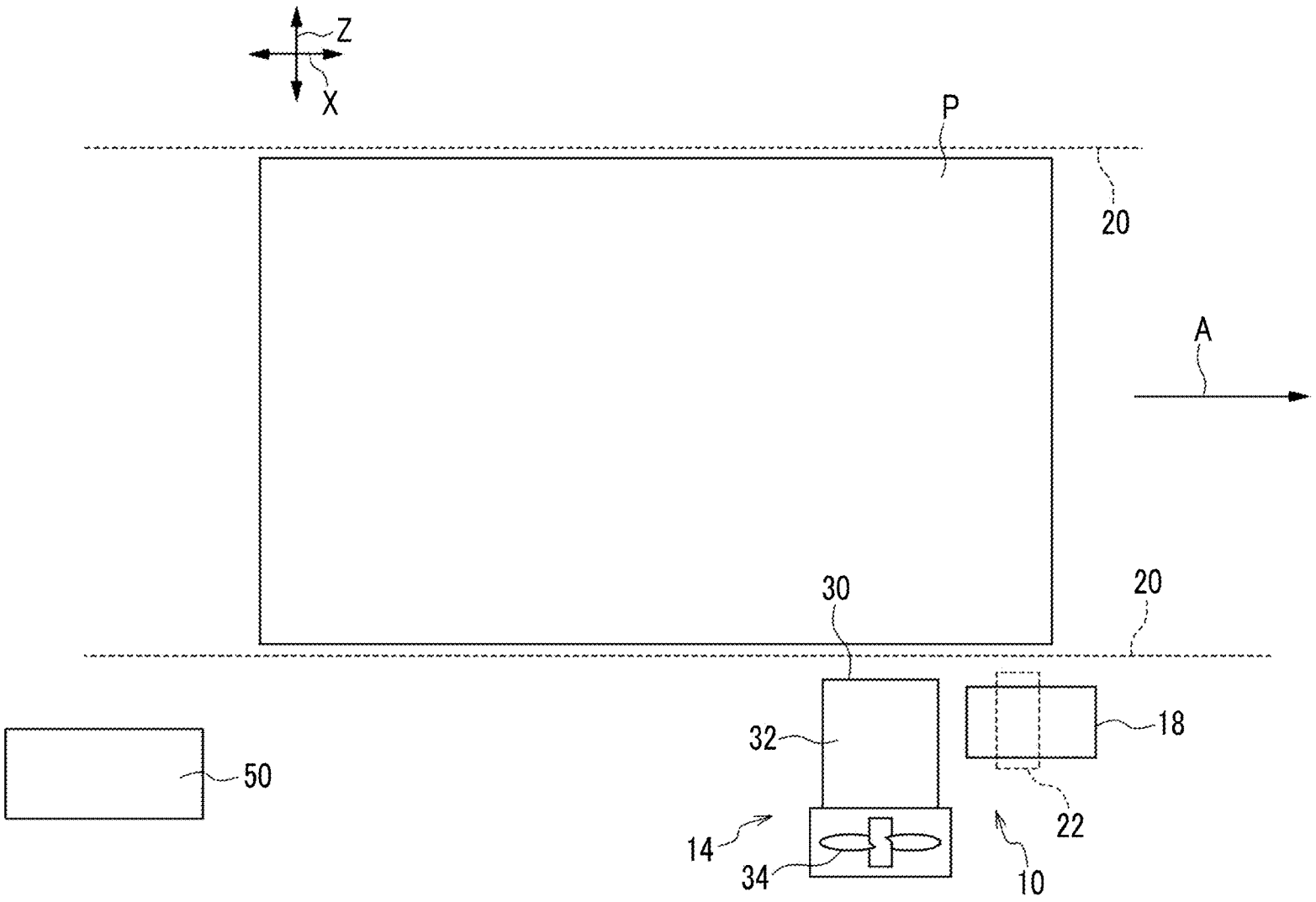
FIG. 2 is a plan view showing a part of the medium supply device according to the first exemplary embodiment.

As shown in FIG. 2, the medium supply device 10 is provided with side guides 20 that restrict positions of side portions of the sheets P loaded on the loading unit 12 in a width direction (in this example, the arrow Z direction). The side guides 20 are arranged on an upper side of the loading unit 12 and are provided on both sides of the side portions of the sheets P in the width direction (arrow Z direction). As an example, the side guide 20 is slidably attached to the loading unit 12 in the apparatus depth direction (arrow Z direction). The side guide 20 can be slid in the apparatus depth direction (arrow Z direction) according to a size of the sheet P. A movement range of the side guide 20 is limited by a stopper (length of a guide slit) or the like (not shown) so as not to interfere with the feeding unit 16.

Supply Unit

As shown in FIGS. 1A and 2, the supply unit 14 includes an air outlet 30 through which air is blown toward an upper side of the loading unit 12 in a direction from the side portion of the sheet P in the width direction (arrow Z direction). The air outlet 30 is arranged at a position facing an upper portion of the plurality of sheets P loaded on the upper side of the plate-shaped body 12A. The supply unit 14 blows air from the air outlet 30 between the plurality of sheets P to float and separate the plurality of sheets P loaded on the plate-shaped body 12A of the loading unit 12.

The supply unit 14 includes a duct 32 connected to the air outlet 30 and a fan 34 provided upstream of the duct 32 in an air flow direction (see FIG. 2). In the supply unit 14, air is supplied to the air outlet 30 through the duct 32 by rotation of the fan 34, and air is blown out from the air outlet 30 to the upper side of the loading unit 12.

Although not shown, the air outlets 30 are provided on both sides of the side portions of the sheets P in the width direction (arrow Z direction). As an example, the air outlets 30 are provided at the side guides 20 on both sides of the side portions of the sheets P in the width direction (arrow Z direction). The duct 32 is branched into two pieces on a side downstream of the fan 34 in the air flow direction, and the air outlet 30 is provided at each downstream end portion of the branched portion of the duct 32.

Feeding Unit

As shown in FIG. 1A, the feeding unit 16 transports the sheets P loaded on the upper side of the plate-shaped body 12A of the loading unit 12 one by one in an arrow A direction, that is, toward a right side in the apparatus width direction (right side in an arrow X direction). The feeding unit 16 includes a feeding roll (supply roll) 36 that feeds the uppermost sheet P on the upper side of the loading unit 12 one by one and a sticking unit 40 arranged inward of the feeding roll 36 in the apparatus width direction (left side in the arrow X direction). The sticking unit 40 causes the uppermost sheet P to stick to the sticking unit. Furthermore, the feeding unit 16 includes a pair of transporting rolls 38 that transport the sheet P fed by the feeding roll 36.

As an example, in the feeding unit 16, in a case where the sheet P caused to stick to the sticking unit 40 comes into contact with the feeding roll 36, the sheet P is fed from the feeding roll 36 in the arrow A direction, and is transported in the arrow A direction by the transporting rolls 38.

Camera

The camera 18 photographs a floated and separated state of the end portions of the sheets P. As shown in FIGS. 1A, 1B, and 2, the camera 18 is provided on a side of the side portions of the sheets Pin the width direction (arrow Z direction). The camera 18 is arranged at a position facing the end portions of the sheet P loaded on the plate-shaped body 12A in the width direction (arrow Z direction). Accordingly, the camera 18 photographs the state in which the sheets P are floated and separated from an outside of the end portions of the sheets P in the width direction. As an example, the cameras 18 are provided on both sides of the end portions of the sheets P in the width direction (arrow Z direction).

As an example, the camera 18 is arranged on an upper portion side of the side guide 20, and is arranged near the end portions of the sheets P on a downstream side in a feeding direction (arrow A direction) in the side guide 20.

Light Irradiation Unit

Figure 5:
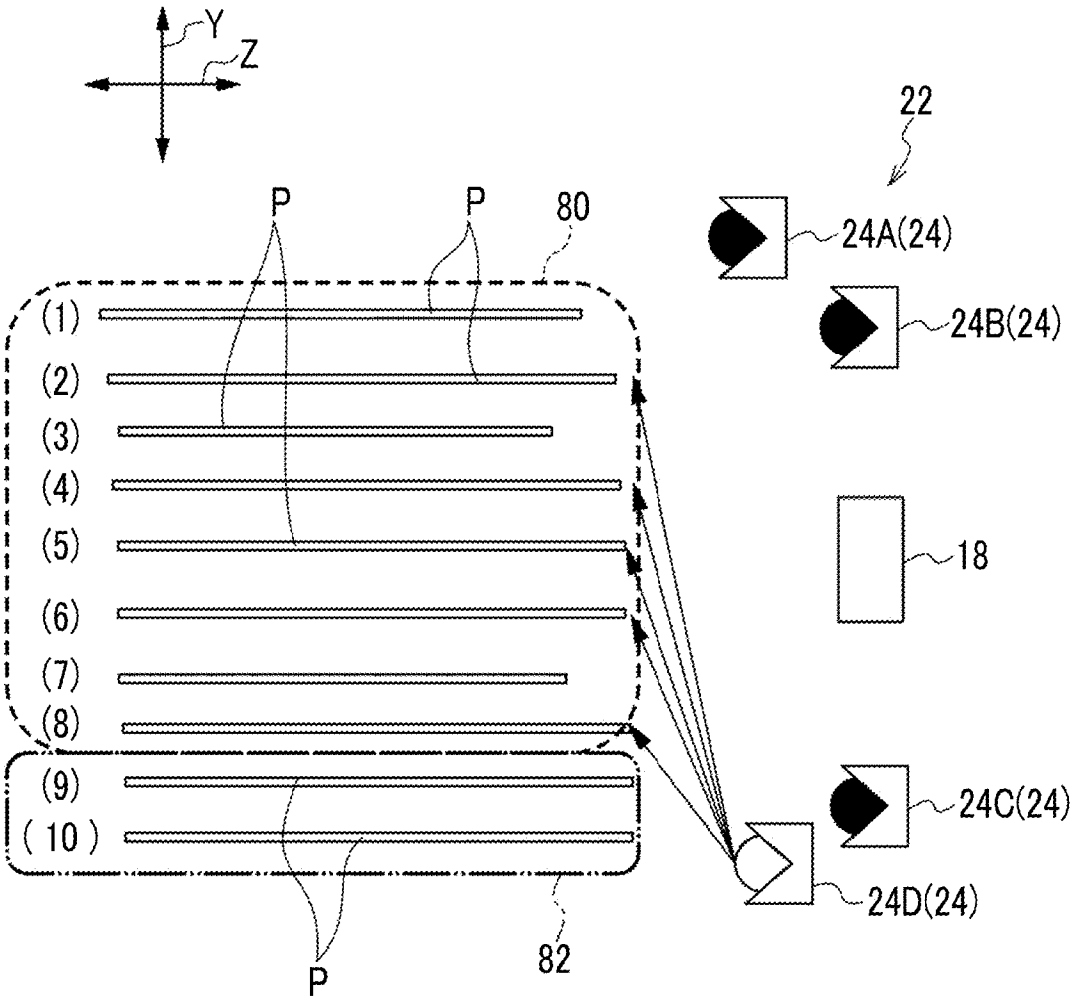
FIG. 5 is a configuration diagram showing a first example of a lighting unit that is turned on when end portions of sheets are photographed by a camera in the medium supply device according to the first exemplary embodiment.

The light irradiation unit 22 irradiates the end portions of the sheets P with light when the end portions of the sheets P are photographed by the camera 18. As shown in FIG. 5, the light irradiation unit 22 irradiates the end portions of the sheets P on the photographing side of the camera 18 with light from a plurality of different positions in the up-down direction. As an example, the light irradiation unit 22 has a plurality of lighting units 24 arranged at different positions in the up-down direction. In the first exemplary embodiment, the plurality of lighting units 24 are four, and includes a first lighting unit 24A, a second lighting unit 24B, a third lighting unit 24C, and a fourth lighting unit 24D arranged from an upper side to a lower side in the up-down direction.

The plurality of lighting units 24 are arranged so as to be displaced in a direction toward or away from the end portions of the sheets P on the photographing side of the camera 18. In the first exemplary embodiment, the first lighting unit 24A at an uppermost portion and the fourth lighting unit 24D at a lowermost portion are arranged on a side approaching the end portions of the sheets P on the photographing side of the camera 18. The second lighting unit 24B and the third lighting unit 24C as intermediate portions in the up-down direction are arranged so as to be displaced in a direction away from the end portions of the sheets P on the photographing side of the camera 18 compared to the first lighting unit 24A and the fourth lighting unit 24D. In a plan view of the medium supply device 10, the second lighting unit 24B and the third lighting unit 24C are arranged so as to overlap each other on a side toward the end portions of the sheets P in the width direction, and the first lighting unit 24A and the fourth lighting unit 24D are arranged so as to overlap each other on a side away from the end portions of the sheets P in the width direction.

As shown in FIG. 5, the camera 18 is arranged at a position facing the plurality of sheets P that are floated and separated by air from the supply unit 14. As an example, the camera 18 is arranged at a center portion in the up-down direction facing the plurality of sheets P that are floated and separated by air from the supply unit 14. Here, the center portion in the up-down direction facing the plurality of sheets P refers to a center of a range in which the plurality of sheets P are scattered when a predetermined amount of air is blown. The first lighting unit 24A and the second lighting unit 24B are arranged on an upper side in the up-down direction with respect to the camera 18. The third lighting unit 24C and the fourth lighting unit 24D are arranged on a lower side in the up-down direction with respect to the camera 18.

As shown in FIGS. 5 to 8, in the light irradiation unit 22, the first lighting unit 24A, the second lighting unit 24B, the third lighting unit 24C, and the fourth lighting unit 24D are turned on in a predetermined order, so that the end portions of the sheets P on the photographing side of the camera 18 are irradiated with light from the plurality of different positions in the up-down direction. The first lighting unit 24A, the second lighting unit 24B, the third lighting unit 24C, and the fourth lighting unit 24D have the identical configuration, and are described as a lighting unit 24 in a case where it is not necessary to distinguish between the four.

Hardware Configuration of Medium Supply Device

Figure 3:
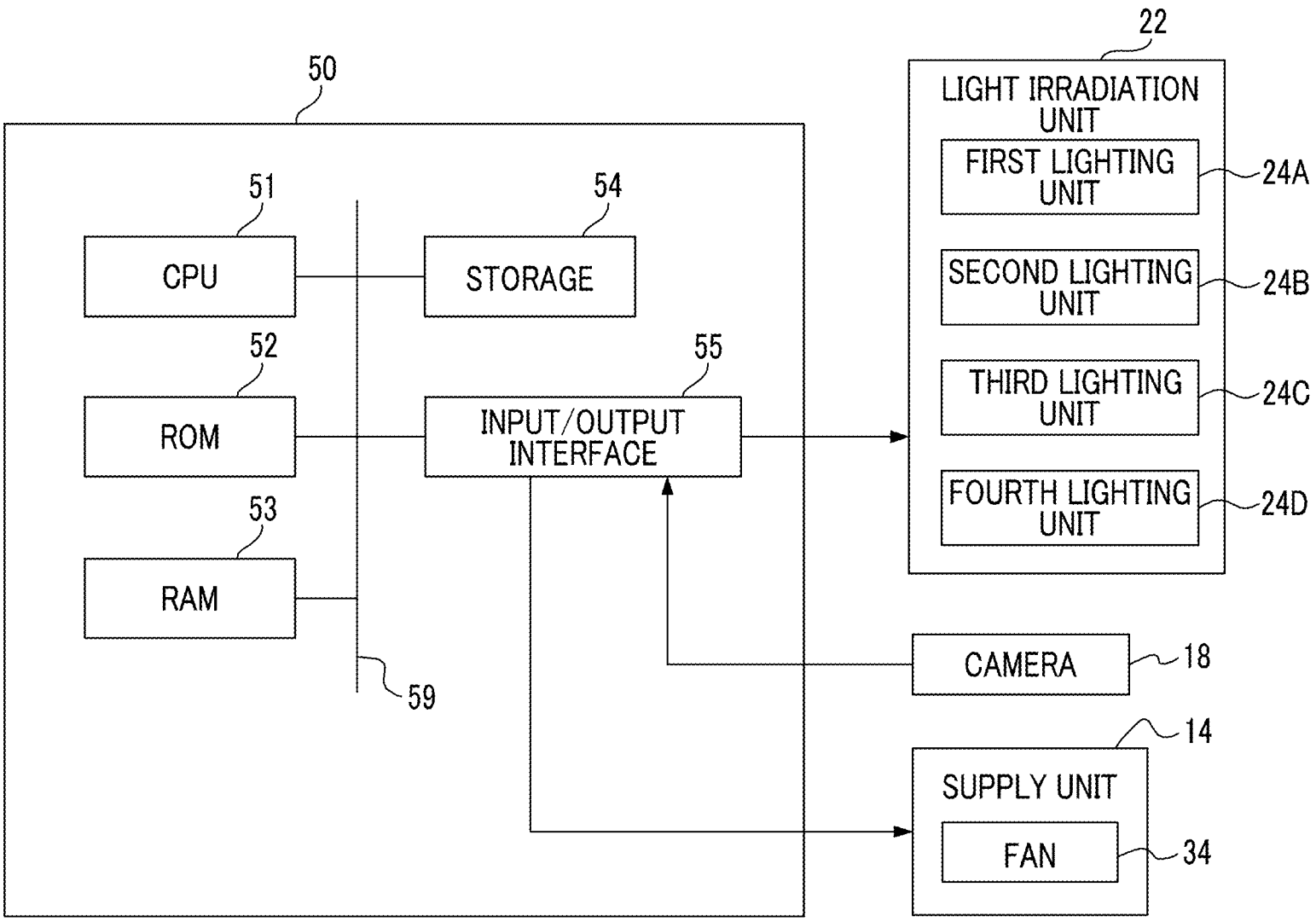
FIG. 3 is a block diagram showing a hardware configuration of the medium supply device according to the first exemplary embodiment.

FIG. 3 is a block diagram showing a hardware configuration of devices mounted in the medium supply device 10. As shown in FIG. 3, the medium supply device 10 includes the control device 50, the camera 18, the supply unit 14, and the light irradiation unit 22 as described above. The light irradiation unit 22 includes the first lighting unit 24A, the second lighting unit 24B, the third lighting unit 24C, and the fourth lighting unit 24D.

The control device 50 has each configuration of a central processing unit (CPU) 51, a read only memory (ROM) 52, a random access memory (RAM) 53, a storage 54, and an input/output interface 55. The configurations are connected via a bus 59 to communicate with each other.

The CPU 51 is a central processing unit and executes various programs and controls each unit. The CPU 51 is an example of the processor. That is, the CPU 51 reads a program from the ROM 52 or the storage 54 and executes the program using the RAM 53 as a work area. The CPU 51 controls each configuration and performs various arithmetic processes according to the programs recorded in the ROM 52 or the storage 54. In the present exemplary embodiment, a detection process program is stored in the ROM 52 or the storage 54.

The ROM 52 stores various programs and various data. The RAM 53 temporarily stores programs or data as a work area. The storage 54 is configured by a hard disk drive (HDD) or a solid state drive (SSD), and stores various programs including an operating system and various data. A program of a printer driver is stored in the storage 54. The CPU 51 reads the program of the printer driver from the storage 54 and executes the program to function as the printer driver.

The input/output interface 55 is an interface for communicating with each device mounted in the medium supply device 10. The control device 50 is connected to the camera 18, the supply unit 14, and the light irradiation unit 22 via the input/output interface 55. The camera 18, the supply unit 14, and the light irradiation unit 22 may be directly connected to each other via the bus 59.

Functional Configuration of Control Device

Figure 4:
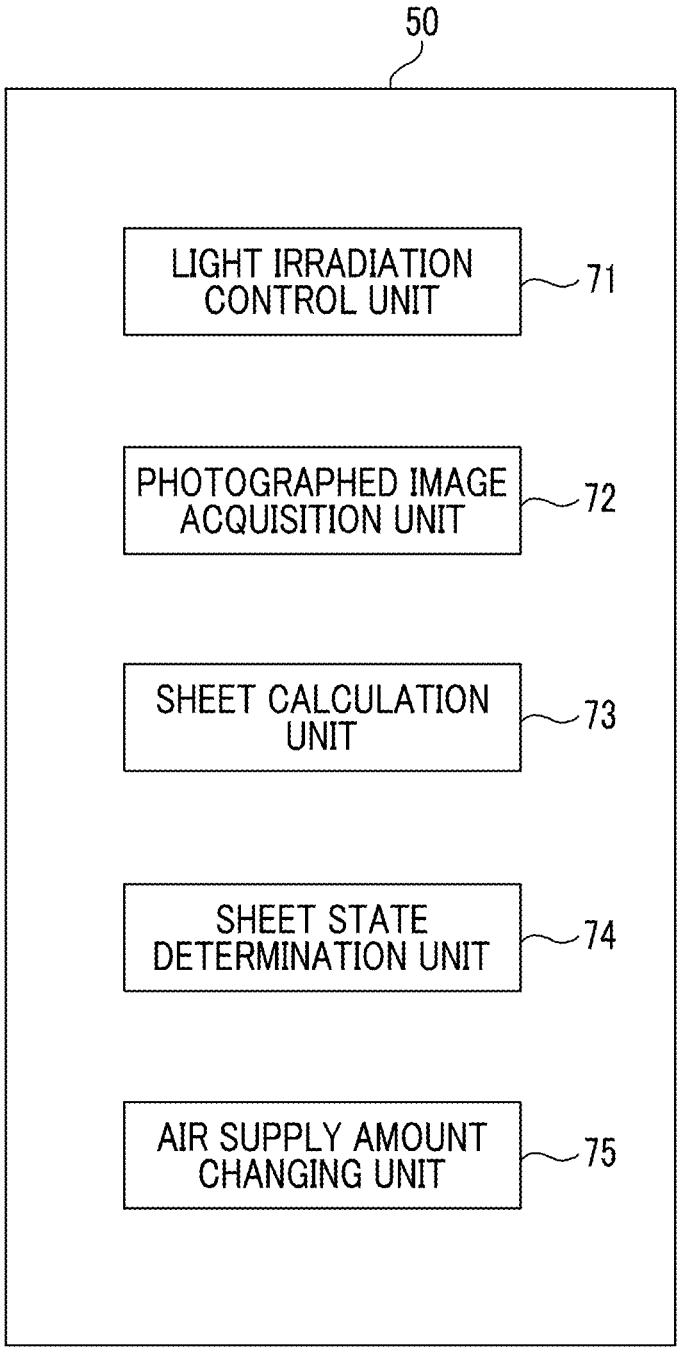
FIG. 4 is a block diagram showing an example of a functional configuration of a control device of the medium supply device according to the first exemplary embodiment.

FIG. 4 is a block diagram showing an example of a functional configuration of the control device 50.

As shown in FIG. 4, the control device 50 has a light irradiation control unit 71, a photographed image acquisition unit 72, a sheet calculation unit 73, a sheet state determination unit 74, and an air supply amount changing unit 75 as functional configurations. The functional configuration is realized by the CPU 51 reading the detection process program stored in the ROM 52 or the storage 54, deploying the detection process program into the RAM 53, and executing the detection process program.

The light irradiation control unit 71 controls turning on and off of the plurality of lighting units 24 in the light irradiation unit 22. More specifically, the light irradiation control unit 71 changes a position in the up-down direction at which the sheets P are irradiated with light by controlling turning on and off of the first lighting unit 24A, the second lighting unit 24B, the third lighting unit 24C, and the fourth lighting unit 24D constituting the plurality of lighting units 24 (see FIGS. 5 to 8). In the first exemplary embodiment, the position in the up-down direction at which the sheets P are irradiated with light by the plurality of lighting units 24 is changed for each frame photographed by the camera 18. One frame is an example of one photographed image. As an example, the light irradiation control unit 71 turns on any one lighting unit 24 (one of the first lighting unit 24A, the second lighting unit 24B, the third lighting unit 24C, and the fourth lighting unit 24D) among the plurality of lighting units 24 in a predetermined order and turns off the other lighting units 24 when one lighting unit 24 is turned on.

The photographed image acquisition unit 72 acquires a photographed image of the end portions of the sheets P in the width direction (arrow Z direction) photographed by the camera 18. The photographed image acquisition unit 72 acquires a plurality of photographed images in which the position in the up-down direction at which the sheets P are irradiated with light by the plurality of lighting units 24 is changed for each frame photographed by the camera 18. As an example, in the medium supply device 10, every time any one of the first lighting unit 24A, the second lighting unit 24B, the third lighting unit 24C, and the fourth lighting unit 24D is turned on in a predetermined order, the camera 18 photographs the end portions of the sheets P, so that the photographed image acquisition unit 72 acquires at least four photographed images.

The sheet calculation unit 73 calculates the position of the end portion of the sheet Pin the width direction based on a photographed image of the end portion of the sheet P photographed by the camera 18 in the width direction (arrow Z direction). The sheet calculation unit 73 excludes a non-discriminable area 82 (see FIGS. 5 to 8) inappropriate for discriminating the sheets P from relative positions between the position in the up-down direction at which light is emitted by the light irradiation unit 22 and the sheets P and detects the end portions of the sheets P of the photographed image corresponding only to the discriminable area 80 (see FIG. 5 or the like) in which the sheets P are discriminable. The non-discriminable area 82 is an example of an area inappropriate for discriminating the sheets P, and the discriminable area 80 is an example of an area in which the sheets P are discriminable. The sheet calculation unit 73 calculates the positions of the end portions of the sheets P in the width direction in the discriminable area 80 to detect a floated and separated state of the end portions of the sheets P in the width direction. A method of detecting the floated and separated state of the end portions of the sheets P in the width direction will be described later.

The sheet state determination unit 74 determines whether or not there is a possibility of a jam or double feed of the sheets P from the floated and separated state of the end portions of the sheets P in the width direction. A condition for determining whether or not there is a possibility of a jam or double feed of the sheets P is stored in advance in the storage 54. This condition will be described later.

The air supply amount changing unit 75 changes the amount of air supplied by the supply unit 14. For example, the air supply amount changing unit 75 changes the amount of air supplied by the supply unit 14 in a case where it is determined that there is a possibility of a jam or double feed of the sheets P.

For example, in a case where the floated and separated state of the sheets P is insufficient (the number of sheets P floated and separated is small), the air supply amount changing unit 75 increases the amount of air supplied by the supply unit 14. In addition, for example, in a case where the number of sheets P floated is too large and a plurality of sheets P are in a bundle and are not sufficiently separated, the air supply amount changing unit 75 reduces the amount of air supplied by the supply unit 14. For example, changing the amount of air supplied by the supply unit 14 is executed by changing a rotation speed of the fan 34.

Configuration and Problems of Medium Supply Device of Comparative Example

Here, a configuration and problems of a medium supply device of a comparative example will be described.

Although not shown, the medium supply device of the comparative example includes one lighting unit of which a position in an up-down direction is fixed, and a camera. Then, an end portion of a sheet Pin a width direction is photographed by the camera in a state of being irradiated with light by the one lighting unit.

In general, in a configuration in which a plurality of sheets P are floated and separated by air blown from a supply unit, the sheets P can easily move in units of several mm in a depth direction facing the camera. Therefore, in the medium supply device of the comparative example, when end portions of the plurality of sheets P are photographed by the camera in a state of being irradiated with light by the one lighting unit, there may be cases where brightness of the end portions of the plurality of sheets P in the up-down direction changes.

FIG. 13 is a photographed image obtained by photographing the end portions of the sheets P in the width direction with the camera in the medium supply device of the comparative example. As shown in FIG. 13, in a first area 302 in the photographed image, the sheet P moved toward a back side in the depth direction with respect to the camera is darker than the other sheets P. This is because the sheet P moved toward the back side in the depth direction with respect to the camera is hidden by another sheet P directly above or directly below the sheet P, and is less likely to be hit by the light of the lighting unit, so that the sheet P looks darker than the other sheets P. Therefore, when a floated and separated state of the plurality of sheets P is detected, there may be cases where the sheets P in the first area 302 cannot be detected.

In addition, as shown in FIG. 13, in a second area 304 in the photographed image, since the lighting unit irradiates the sheets P with light from a front side of the sheets P, upper surfaces of the sheets P shine. Therefore, there may be cases where the sheets P are erroneously detected as thick sheets P. In addition, depending on a position of the camera, as the sheets P are irradiated with light from the front side, lower surfaces of the sheets may shine, and there may be cases where the sheets P are also erroneously detected as thick sheets P.

On the other hand, in the medium supply device 10 of the first exemplary embodiment, in order to suppress erroneous detection of the sheets P, the following process of detecting the end portions of the sheets P is performed.

Process of Detecting End Portions of Sheets P

In the medium supply device 10, a plurality of photographed images are acquired by photographing the end portions of the sheets P by the camera 18 in a state in which the position in the up-down direction at which the sheets P are irradiated with light by the plurality of lighting units 24 is changed. Furthermore, the CPU 51 of the control device 50 performs a process of detecting (for example, performing an image analysis) positions of the end portions of the sheets P in the width direction (arrow Z direction) based on the plurality of photographed images.

FIGS. 5 to 8 schematically show states of the plurality of sheets P photographed by the camera 18 when turning-on positions of the plurality of lighting units 24 in the up-down direction are changed. In addition, in FIGS. 5 to 8, in order to facilitate understanding of which sheet P is among the plurality of sheets P, a position of the sheet P from the top is indicated by a number in parentheses.

As shown in FIG. 5, when the fourth lighting unit 24D at the lowermost portion in the up-down direction is turned on, the second, fourth, fifth, sixth, and eighth sheets P from the top are recognized as the end portions of the sheets P. The first, third, and seventh sheets P are displaced toward the back side in the depth direction with respect to the camera 18, and are less likely to be detected. In addition, there may be cases where upper surfaces or lower surfaces of the ninth and tenth sheets P appear shining, resulting in erroneous detection. Therefore, when the fourth lighting unit 24D at the lowermost portion in the up-down direction is turned on, the CPU 51 sets the first to eighth sheets P as the discriminable area 80, and sets the ninth and tenth sheets P as the non-discriminable area 82.

Figure 6:
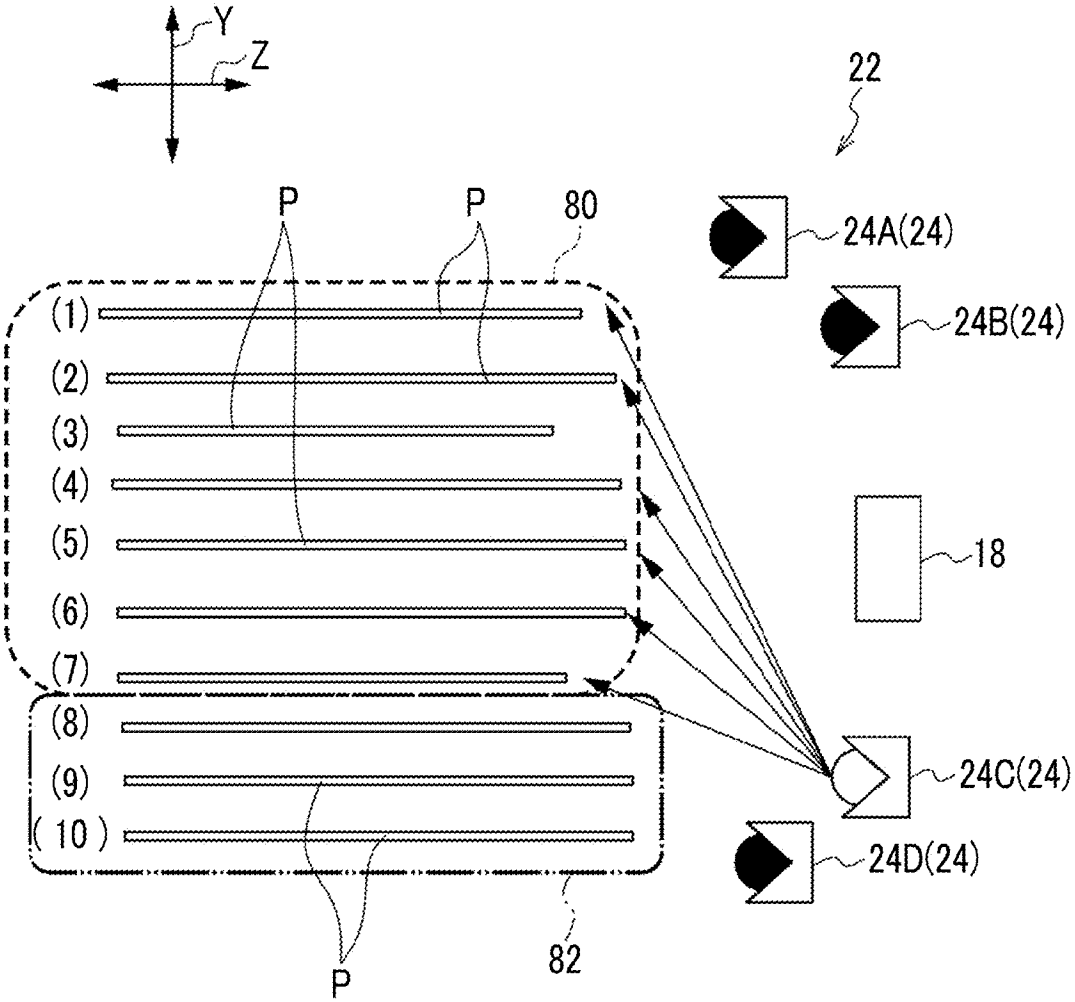
FIG. 6 is a configuration diagram showing a second example of the lighting unit that is turned on when the end portions of the sheets is photographed by the camera in the medium supply device according to the first exemplary embodiment.

As shown in FIG. 6, when the third lighting unit 24C that is second from the lower side in the up-down direction is turned on, the first, second, fourth, fifth, sixth, and seventh sheets P from the top are recognized as the end portions of the sheets P. The third sheet P is displaced toward the back side in the depth direction with respect to the camera 18, and is less likely to be detected. In addition, there may be cases where upper surfaces or lower surfaces of the eighth, ninth, and tenth sheets P appear shiny, resulting in erroneous detection. Therefore, when the third lighting unit 24C that is second from the lower side in the up-down direction is turned on, the CPU 51 sets the first to seventh sheets P as the discriminable area 80, and sets the eighth to tenth sheets P as the non-discriminable area 82.

Figure 7:
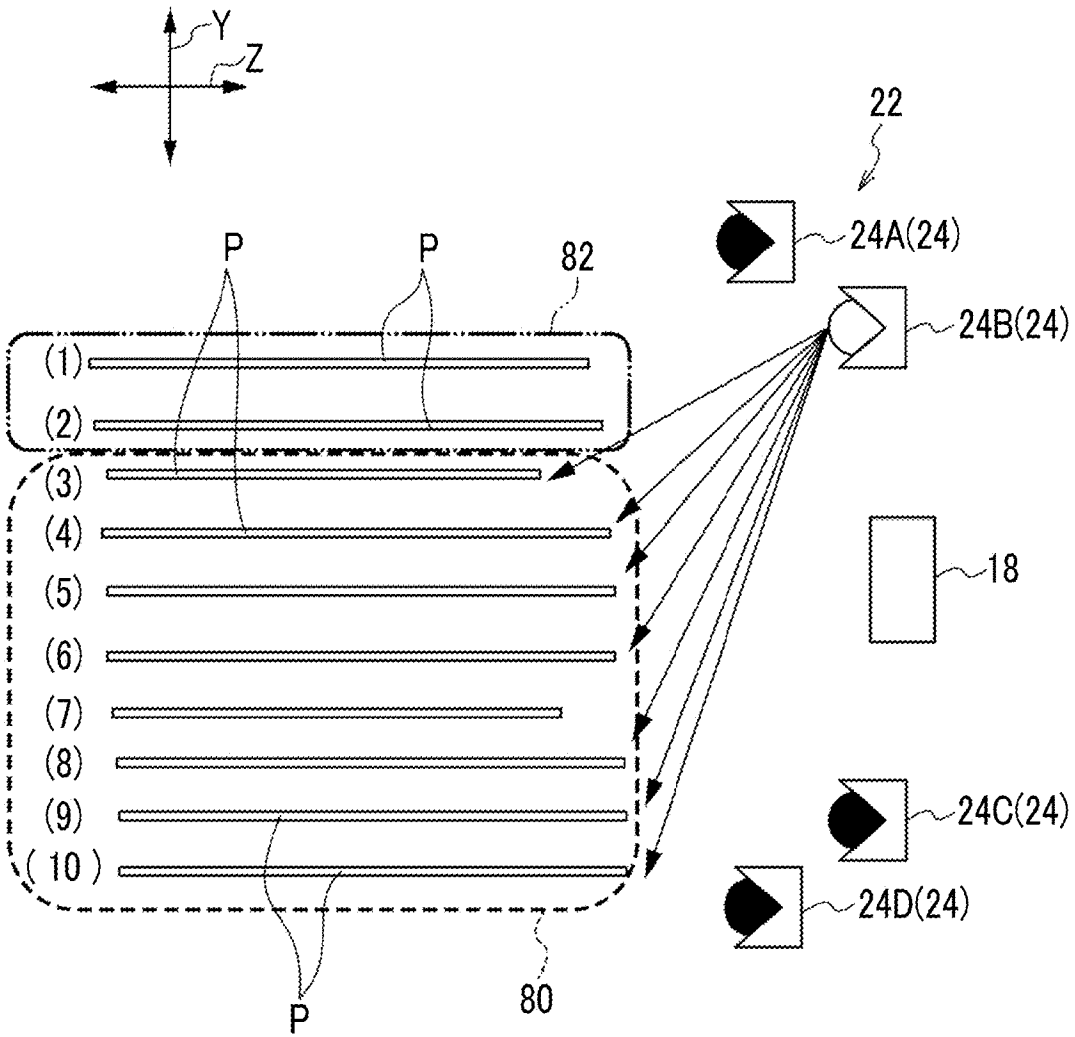
FIG. 7 is a configuration diagram showing a third example of the lighting unit that is turned on when the end portions of the sheets is photographed by the camera in the medium supply device according to the first exemplary embodiment.

As shown in FIG. 7, when the second lighting unit 24B that is second from the upper side in the up-down direction is turned on, the third, fourth, fifth, sixth, eighth, ninth, and tenth sheets P from the top are recognized as the end portions of the sheets P. The seventh sheet P is displaced toward the back side in the depth direction with respect to the camera 18, and is less likely to be detected. In addition, there may be cases where upper surfaces or lower surfaces of the first and second sheets P appears shining, resulting in erroneous detection. Therefore, when the second lighting unit 24B that is second from the upper side in the up-down direction is turned on, the CPU 51 sets the third to tenth sheets P as the discriminable area 80, and sets the first to second sheets P as the non-discriminable area 82.

Figure 8:
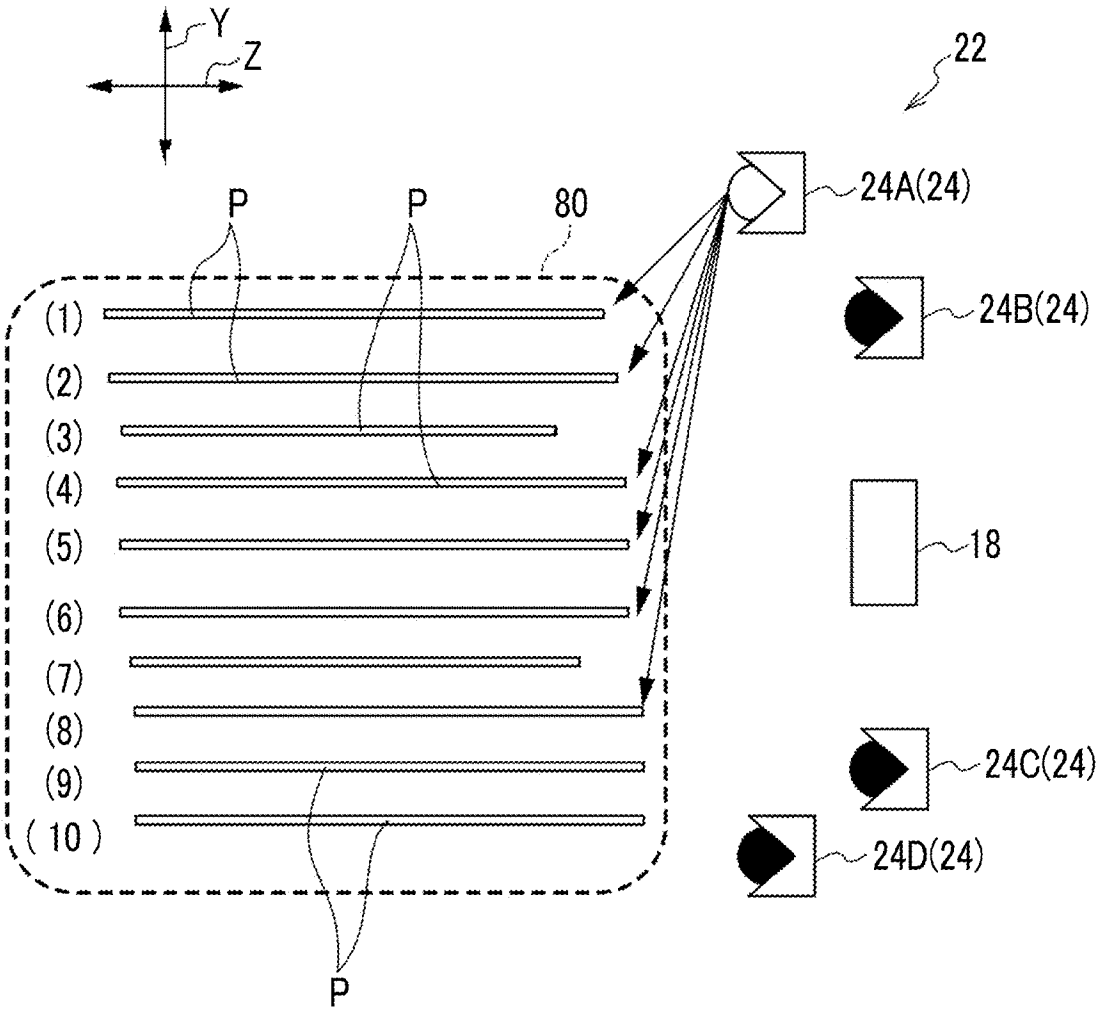
FIG. 8 is a configuration diagram showing a fourth example of the lighting unit that is turned on when the end portions of the sheets is photographed by the camera in the medium supply device according to the first exemplary embodiment.

As shown in FIG. 8, when the first lighting unit 24A at the uppermost portion in the up-down direction is turned on, the first, second, fourth, fifth, sixth, and eighth sheets P from the top are recognized as the end portions of the sheets P. The third and seventh sheets P are displaced toward the back side in the depth direction with respect to the camera 18, and are less likely to be detected. In addition, the ninth and tenth sheets P are hidden by the eighth sheet P, and are less likely to be detected. When the plurality of sheets P are floated and separated, since the first lighting unit 24A is arranged on the upper side in the up-down direction with respect to the first sheet P from the top, the sheets P are not irradiated with light from the front surface side, and shining of the upper surfaces or lower surfaces of the sheets P is suppressed. Therefore, when the first lighting unit 24A at the uppermost portion in the up-down direction is turned on, the CPU 51 sets the first to tenth sheets P as the discriminable area 80. As shown in FIGS. 5 to 8, the discriminable area 80 and the non-discriminable area 82 are determined based on the relative positions between the position in the up-down direction at which light is emitted by the plurality of lighting units 24 of the light irradiation unit 22 and the sheets P.

A part (A) in FIG. 9 shows an example of actual positions of a plurality of sheets P. A part (B) in FIG. 9 shows an example of an image of a first frame when the plurality of sheets P are photographed by the camera 18, and a part (C) in FIG. 9 shows an example of an image of a second frame when the plurality of sheets P are photographed by the camera 18. As shown in the part (A) in FIG. 9, first to fifth sheets P are arranged at equal intervals. As shown in the part (B) in FIG. 9, a third sheet P is not visible in the image of the first frame. Therefore, in the image of the first frame, the third sheet P is excluded. As shown in the part (C) in FIG. 9, a fourth sheet P is not visible in the image of the second frame. Therefore, in the image of the second frame, the fourth sheet P is excluded.

Parts (A) and (B) in FIG. 10 show an example of a flow of the detection process of the end portions of the sheets P by the CPU 51 in the case shown in FIG. 9. As shown in the part (A) in FIG. 10, the CPU 51 excludes the third sheet Pin the image of the first frame, and detects center positions (that is, center coordinate positions in a thickness direction of the sheets P) of the first, second, fourth, and fifth sheets P. Furthermore, for the first, second, fourth, and fifth sheets P, the CPU 51 creates filters 90 thickened by a width in the thickness direction determined from the center positions of the end portions of the sheets P.

As shown in the part (B) in FIG. 10, the CPU 51 excludes the fourth sheet P in the image of the second frame, and detects center positions (that is, center coordinate positions in a thickness direction of the sheets P) of the first, second, third, and fifth sheets P. When the center positions of the first, second, third, and fifth sheets P fall within the filters 90 created based on the image of the first frame, the CPU 51 determines the identical sheets P (see the figure shown on the left side of the part (B) in FIG. 10).

The CPU 51 performs an AND operation on the filters 90 shown on the right side of the part (A) in FIG. 10 and the center positions of the sheets P shown on the left side of the part (B) in FIG. 10, and calculates a center position of a new sheet P. More specifically, as shown in the part (B) in FIG. 10, in the image of the second frame, for the first, second, third, and fifth sheets P, the CPU 51 creates the filters 90 thickened by the width in the thickness direction determined from the center positions of the end portions of the sheets P. Furthermore, in the image of the second frame, the CPU 51 creates a filter 90 at the identical position as the filter 90 of the fourth sheet P (see the part (A) in FIG. 10) created based on the image of the first frame. That is, in the image of the second frame, the filter 90 is updated. The CPU 51 repeats the above process in the order of frames photographed by the camera 18.

The above detection process is summarized as follows. The CPU 51 detects center positions of sheets P of an image in an nth frame (that is, center coordinate positions of sheets P in a thickness direction) (see the part (A) in FIG. 10). A case where an end portion of a sheet P is unclear, or a sheet P in the non-discriminable area 82 (that is, the sheet P having a possibility that a lower surface or an upper surface of the sheet P shines) is ignored. The image in the nth frame is an example of an nth photographed image. The CPU 51 creates filters 90 thickened by the width in the thickness direction determined from the center positions of the end portions of the sheets P detected in the image of the nth frame (see the part (A) in FIG. 10).

Similarly to the above description, the CPU 51 detects the center positions of the sheets P (that is, the center coordinate positions of the sheets Pin the thickness direction) of an image of an (n+1)th frame (see the part (B) in FIG. 10). The image in the (n+1)th frame is an example of an (n+1)th photographed image. The CPU 51 compares the positions of the end portions of the sheets P detected for each image of each frame by the camera 18 with each other, determines that, in a case where a difference between the positions of the end portions of the sheets P is equal to or less than a threshold, the sheets P are identical, and detects, in a case where the difference is larger than the threshold, a new sheet P. In the first exemplary embodiment, the CPU 51 determines that the sheets P are identical when the center position of the end portion of the sheet P detected in the (n+1)th frame falls within the filter 90. The CPU 51 is updated with a new filter 90 that is thickened by the width in the thickness direction determined from the center position of the end portion of the sheet P of the image of the (n+1)th frame (see the part (B) in FIG. 10). When the sheet P is excluded in the image of the (n+1)th frame, the CPU 51 creates the filter 90 at the identical position as the filter 90 in the sheet P in the image of the nth frame. By repeating the above process, the CPU 51 detects the positions of the end portions of the sheets P, that is, performs an image analysis of the end portions of the sheets P.

Condition for Determining State of Sheets P

Next, a condition for determining whether or not there is a possibility of a jam or double feed of the sheets P by the control device 50 will be described.

The CPU 51 of the control device 50 detects the floated and separated state of the end portions of the sheets P by detecting the positions of the end portions of the sheets P by the detection process described above. Furthermore, the CPU 51 determines whether or not there is a possibility of a jam or double feed of the sheets P. The condition for determining that there is a possibility of a jam or double feed of the sheets P is a case where sheets P of which the number is a first threshold (for example, four), which is a predetermined number, or less are floated. In addition, the condition for determining that there is a possibility of a jam or double feed of the sheets P is a case where sheets P of which the number is a second threshold (for example, three), which is a predetermined number, or more are not separated but are in a bundle. In the above case, the CPU 51 determines that there is a possibility of a jam or double feed of the sheets P. The first threshold and the second threshold described above can be changed.

Parts (A) to (C) in FIG. 11 show examples of a state of the sheets P when air is blown from the air outlet 30 of the supply unit 14 toward the sheets P loaded on the plate-shaped body 12A of the loading unit 12. In a first example shown in the part (A) in FIG. 11, about 10 sheets P on an upper portion side are independently separated and floated, so that the floated and separated state of the sheets P is good. In this state, even in a case where the sheets P are sequentially transported by the feeding unit 16, a double feed of the sheets P or the like is less likely to occur. In such a case, based on the above condition, the CPU 51 determines that there is no possibility of a jam or double feed of the sheets P.

In a second example shown in the part (B) in FIG. 11, the number of sheets P floated is only about one, and the floated and separated state of the sheets P is insufficient. In this state, in a case where the sheets P are sequentially transported by the feeding unit 16, there is a possibility of a supply failure (that is, misfeed) in which the sheets P are not smoothly supplied. In such a case, based on the above condition, the CPU 51 determines that there is a possibility of a jam or double feed of the sheets P.

In a third example shown in the part (C) in FIG. 11, since air is blown too strongly from the air outlet 30, the sheets P on the upper portion side are in a bundle and are floated, so that the floated and separated state of the sheets P is insufficient. In this state, in a case where the sheets P are sequentially transported by the feeding unit 16, there is a possibility of a double feed of the sheets P. In such a case, based on the above condition, the CPU 51 determines that there is a possibility of a jam or double feed of the sheets P.

Actions and Effects

Next, actions of the first exemplary embodiment will be described.

FIG. 12 is a flowchart showing a flow of the detection process in charge of the control device 50. The detection process is performed by the CPU 51 reading the detection process program from the ROM 52 or the storage 54, deploying the detection process program into the RAM 53, and executing the detection process program.

Before the detection process shown in FIG. 12 is executed, a user instructs the image forming apparatus 100 to print image data on the sheets P. In a case where the image forming apparatus 100 receives the printing instruction, the medium supply device 10 supplies air through the supply unit 14 to float and separate the sheets P loaded on the loading unit 12.

The CPU 51 starts supplying the sheets P (step S201).

The CPU 51 acquires a plurality of photographed images in which the end portions of the sheets P in the width direction are photographed by the camera 18 (step S202). As shown in FIGS. 5 to 8, in the medium supply device 10, the end portions of the sheets P are photographed by the camera 18 in a state in which the position in the up-down direction at which the sheets P are irradiated with light by the plurality of lighting units 24 constituting the light irradiation unit 22 is changed. Accordingly, the CPU 51 acquires the plurality of photographed images in which the end portions of the sheets Pin the width direction are photographed by the camera 18.

The CPU 51 detects a state of the sheets P, that is, a floated and separated state of the end portions of the sheets P (step S203). As shown in FIGS. 5 to 8, the CPU 51 excludes the non-discriminable area 82 in the plurality of photographed images, and detects the end portions of the sheets P of the photographed image corresponding only to the discriminable area 80. As shown in FIGS. 9 and 10, the CPU 51 performs the detection process of the end portions of the sheets P in the order of the photographed images photographed by the camera 18, based on the flow of the detection process of the end portions the sheets P. The CPU 51 detects the positions of the end portions of the sheets P by repeating the process shown in FIG. 10 (that is, performs an image analysis of the positions of the end portions of the sheets P). Accordingly, the CPU 51 detects the floated and separated state of the end portions of the sheets P.

The CPU 51 determines whether or not there is a possibility of a jam or double feed of the sheets P (step S204). For example, the CPU 51 determines whether or not there is a possibility of a jam or double feed of the sheets P based on the condition of the detection.

In a case where there is no possibility of a jam or double feed of the sheets P (NO in step S204), the CPU 51 continues an operation of supplying the sheets P (step S205). That is, the amount of air supplied by the supply unit 14 is not changed.

In a case where there is a possibility of a jam or double feed of the sheets P (YES in step S204), the CPU 51 changes the amount of air supplied by the supply unit 14 (step S206). Accordingly, the floated and separated state of the sheets P loaded on the loading unit 12 are adjusted. Furthermore, the CPU 51 returns to the process of step S202. Accordingly, the process based on the detection process program in charge of the control device 50 is ended.

In addition, after step S206, in a case where a predetermined time has elapsed, the CPU 51 may display an alert indicating that there is a possibility of a jam or double feed of the sheets P, and stop supplying of the sheets P.

In the medium supply device 10 described above, the light irradiation unit 22 irradiates the end portions of the sheets P on the photographing side of the camera 18 with light from a plurality of different positions in the up-down direction, the camera 18 photographs the floated and separated state of the sheets P. Therefore, in the medium supply device 10, the plurality of sheets P photographed by the camera 18 may be accurately detected compared to a case where sheets are irradiated with only light from one identical position in an up-down direction. Accordingly, a transport failure of the sheets P is reduced compared to the case where sheets are irradiated with only light from one identical position in an up-down direction.

In addition, in the medium supply device 10, the CPU 51 changes the amount of air supplied by the supply unit 14 in a case where it is determined by the image photographed by the camera 18 that there is a possibility of a jam or double feed of the sheets P. Therefore, in the medium supply device 10, a jam or double feed of the sheets P may be suppressed compared to a case where the amount of air supplied is always constant.

In addition, in the medium supply device 10, for each photographed image photographed by the camera 18, the CPU 51 changes the position in the up-down direction at which the sheets P are irradiated with light by the light irradiation unit 22 and acquires the photographed images. Therefore, in the medium supply device 10, the plurality of sheets P photographed by the camera 18 may be accurately detected compared to a case where a plurality of photographed images are acquired by irradiating sheets with light from the identical position in an up-down direction.

In addition, in the medium supply device 10, the light irradiation unit 22 has the plurality of lighting units 24 arranged at different positions in the up-down direction. Therefore, a structure of the medium supply device 10 is simple compared to a case where one light irradiation unit is used to irradiate sheets with light from different positions in an up-down direction.

In addition, in the medium supply device 10, the plurality of lighting units 24 are arranged so as to be displaced in a direction toward or away from the end portions of the sheets P on the photographing side of the camera 18. Therefore, in the medium supply device 10, the plurality of sheets P photographed by the camera 18 may be accurately detected compared to a case where a plurality of irradiation units are arranged at the identical distance with respect to end portions of sheets on a photographing side of a camera.

In addition, in the medium supply device 10, the camera 18 is arranged at a position facing the plurality of sheets P that are floated and separated by the supply unit 14, and the lighting unit 24 is arranged at least on the upper side in the up-down direction with respect to the camera 18. That is, the lighting unit 24 is arranged at a position close to the uppermost sheet P fed by the feeding unit 16. Therefore, in the medium supply device 10, the plurality of sheets P photographed by the camera 18 may be accurately detected, compared to a case where a lighting unit is arranged only on a lower side in an up-down direction with respect to a camera.

In addition, in the medium supply device 10, the plurality of lighting units 24 are arranged on the upper side and the lower side in the up-down direction with respect to the camera 18. Therefore, in the medium supply device 10, the plurality of sheets P photographed by the camera 18 may be accurately detected, compared to a case where a lighting unit is arranged only on an upper side in an up-down direction with respect to a camera.

In addition, in the medium supply device 10, the camera 18 is arranged at a center portion in the up-down direction facing the plurality of sheets P that are floated and separated by the supply unit 14. Therefore, in the medium supply device 10, the plurality of sheets P photographed by the camera 18 may be accurately detected, compared to a case where a camera is arranged on a lower side in an up-down direction of a plurality of media floated and separated by a supply unit.

In addition, in the medium supply device 10, the CPU 51 excludes the non-discriminable area 82 inappropriate for discriminating the sheets P from the relative positions between the position in the up-down direction at which light is emitted by the light irradiation unit 22 and the sheets P, and detects the end portions of the sheets P of the photographed image corresponding only to the discriminable area 80 in which the sheets P are discriminable. Therefore, in the medium supply device 10, the plurality of sheets P may be accurately detected, compared to a case where end portions of sheets are detected from the entire photographed image.

In addition, in the medium supply device 10, the CPU 51 compares the positions of the end portions of the sheets P detected for each photographed image with each other, determines that, in a case where a difference between the positions of the end portions of the sheets P is equal to or less than the threshold, the sheets P are identical, and detects, in a case where the difference is larger than the threshold, a new sheet P. Therefore, in the medium supply device 10, the plurality of sheets P may be accurately detected, compared to a case where identity of detected sheets for each photographed image is not determined.

In addition, in the medium supply device 10, the CPU 51 creates the filter 90 thickened by the width in the thickness direction determined from the center position of the end portion of the sheet P detected in the nth photographed image. Then, the CPU 51 determines that the sheets P are identical when the center position of the end portion of the sheet P detected in the (n+1)th photographed image falls within the filter 90, and updates the filter 90 to a new filter 90 thickened by the width in the thickness direction determined from the center position of the end portion of the sheet P of the (n+1)th photographed image. Therefore, in the medium supply device 10, the plurality of sheets P may be accurately detected compared to a case where an identical filter is always used.

In addition, the image forming apparatus 100 includes the medium supply device 10 and the image forming unit 102 that forms an image on the sheet P supplied by the medium supply device 10. Therefore, in the image forming apparatus 100, the plurality of sheets P photographed by the camera 18 may be accurately detected compared to a case where sheets are irradiated with light from one identical position in an up-down direction.

Supplementary Description

In the medium supply device of the first exemplary embodiment, the number of the plurality of lighting units 24 can be changed. For example, it is preferable that the plurality of lighting units 24 are arranged on at least the upper side in the up-down direction with respect to the camera 18. In addition, the position of the plurality of lighting units 24 in the depth direction with respect to the end portions of the sheets P on the photographing side of the camera 18 may be changed.

In addition, in the medium supply device of the first exemplary embodiment, a positional relationship between the plurality of lighting units 24 and the camera 18 in the up-down direction may be changed.

In addition, in the medium supply device of the first exemplary embodiment, the light irradiation unit 22 can be changed to another configuration as long as the end portions of the sheets P on the photographing side of the camera 18 are irradiated with light from a plurality of different positions in the up-down direction. For example, the light irradiation unit may have one lighting unit, and the lighting unit may be configured to move in the up-down direction. Alternatively, one light irradiation unit may be provided and configured to change a shining position in the up-down direction using a mirror that reflects light.

In addition, in the medium supply device of the first exemplary embodiment, ranges of the discriminable area 80 and the non-discriminable area 82 can be changed according to the relative positions between the turning-on positions of the lighting units 24 and the sheets P.

In addition, in the medium supply device of the first exemplary embodiment, the camera 18 is provided on each of both sides of the sheets P in the width direction, but the present disclosure is not limited to this configuration. For example, the camera 18 may be configured to be provided on either one side of the sheets P in the width direction.

The process of the medium supply device 10 described above can also be realized by a dedicated hardware circuit. In this case, the process may be executed by one hardware or may be executed by a plurality of pieces of hardware.

In addition, the program for operating the medium supply device 10 may be provided by a computer-readable recording medium such as a Universal Serial Bus (USB) memory, a flexible disk, or a Compact Disc Read Only Memory (CD-ROM), or may be provided online via a network such as the Internet. In this case, the program recorded on the computer-readable recording medium is usually transferred to a memory, a storage, or the like and stored. In addition, for example, this program may be provided as a single application software, or may be incorporated into software of each device as a function of the medium supply device 10 and the image forming apparatus 100.

Although the present invention has been described in detail with respect to a specific exemplary embodiment, the present invention is not limited to such an exemplary embodiment, and it will be apparent to a person skilled in the art that various other exemplary embodiments are possible within the scope of the present invention.

Supplementary Note (((1)))

A medium supply device comprising:

a loading unit on which media are loadable in an up-down direction;

a supply unit that supplies air to a plurality of the media loaded on the loading unit to float and separate the plurality of media;

a transporting unit that sequentially feed the media that are floated and separated by the supply unit;

a photographing unit that photographs a state in which the media are floated and separated by the supply unit; and a light irradiation unit that irradiates end portions of the media on a photographing side of the photographing unit with light from a plurality of different positions in the up-down direction.

(((2)))

The medium supply device according to (((1))), further comprising:

at least one processor, wherein the processor is configured to:

in a case where it is determined by an image photographed by the photographing unit that there is a possibility of a jam or double feed of the media, change the amount of air supplied by the supply unit.

(((3)))

The medium supply device according to (((1))) or (((2), further comprising:

at least one processor, wherein the processor is configured to:

for each photographed image photographed by the photographing unit, change a position in the up-down direction at which the media are irradiated with light by the light irradiation unit and acquire the photographed image.

(((4)))

The medium supply device according to any one of (((1))) to (((3))), wherein the light irradiation unit has a plurality of lighting units arranged at different positions in the up-down direction.

(((5)))

The medium supply device according to (((4))), wherein the plurality of lighting units arranged to be displaced in a direction toward or away from the end portions of the media on the photographing side of the photographing unit.

(((6)))

The medium supply device according to (((4))) or (((5))), wherein the photographing unit is arranged at a position facing the plurality of media floated and separated by the supply unit, and the lighting unit is arranged at least on an upper side in the up-down direction with respect to the photographing unit.

(((7)))

The medium supply device according to (((6))), wherein the plurality of lighting units are arranged on the upper side and a lower side in the up-down direction with respect to the photographing unit.

(((8)))

The medium supply device according to any one of (((1))) to (((7))), wherein the photographing unit is arranged at a center portion in the up-down direction facing the plurality of media floated and separated by the supply unit.

(((9)))

The medium supply device according to (((3))), wherein the processor is configured to:

exclude an area inappropriate for discriminating the media from relative positions between the position in the up-down direction at which light is emitted by the light irradiation unit and the media, and detect the end portions of the media of the photographed image corresponding only to an area in which the media are discriminable.

(((10)))

The medium supply device according to (((3))) or (((9))), wherein the processor is configured to:

compare positions of the end portions of the media detected for each photographed image with each other, determine that, in a case where a difference between the positions of the end portions of the media is equal to or less than a threshold, the media are identical, and detect, in a case where the difference is larger than the threshold, a new medium.

(((11)))

The medium supply device according to (((10))), wherein the processor is configured to:

create a filter thickened by a width in a thickness direction determined from a center position of the end portion of the medium detected in an nth photographed image, and when a center position of the end portion of the medium detected in an (n+1)th photographed image falls within the filter, the processor determines that the media are identical, and updates the filter to a new filter thickened by the width in the thickness direction determined from the center position of the end portion of the medium of the (n+1)th photographed image.

(((12)))

An image forming apparatus comprising:

the medium supply device according to any one of (((1))) to (((11))); and an image forming unit that forms an image on the medium supplied by the medium supply device.

In the embodiments above, the term "processor" refers to hardware in a broad sense. Examples of the processor include general processors (e.g., CPU: Central Processing Unit) and dedicated processors (e.g., GPU: Graphics Processing Unit, ASIC: Application Specific Integrated Circuit, FPGA: Field Programmable Gate Array, and programmable logic device). In the embodiments above, the term "processor" is broad enough to encompass one processor or plural processors in collaboration which are located physically apart from each other but may work cooperatively. The order of operations of the processor is not limited to one described in the embodiments above, and may be changed.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A medium supply device comprising:

a loading unit on which media are loadable in an up-down direction;

a supply unit that supplies air to a plurality of the media loaded on the loading unit to float and separate the plurality of media;

a transporting unit that sequentially feed the media that are floated and separated by the supply unit;

a photographing unit that photographs a state in which the media are floated and separated by the supply unit; and a light irradiation unit that irradiates end portions of the media on a photographing side of the photographing unit with light from a plurality of different positions in the up-down direction, wherein the light irradiation unit has a plurality of lighting units arranged at different positions in the up-down direction.

2. The medium supply device according to claim 1, further comprising:

at least one processor, wherein the processor is configured to:

in a case where it is determined by an image photographed by the photographing unit that there is a possibility of a jam or double feed of the media, change the amount of air supplied by the supply unit.

3. An image forming apparatus comprising:

the medium supply device according to claim 2; and an image forming unit that forms an image on the medium supplied by the medium supply device.

4. The medium supply device according to claim 1, further comprising:

at least one processor, wherein the processor is configured to:

for each photographed image photographed by the photographing unit, change a position in the up-down direction at which the media are irradiated with light by the light irradiation unit and acquire the photographed image.

5. The medium supply device according to claim 4, wherein the processor is configured to:

exclude an area inappropriate for discriminating the media from relative positions between the position in the up-down direction at which light is emitted by the light irradiation unit and the media, and detect the end portions of the media of the photographed image corresponding only to an area in which the media are discriminable.

6. The medium supply device according to claim 4, wherein the processor is configured to:

compare positions of the end portions of the media detected for each photographed image with each other, determine that, in a case where a difference between the positions of the end portions of the media is equal to or less than a threshold, the media are identical, and detect, in a case where the difference is larger than the threshold, a new medium.

7. The medium supply device according to claim 6, wherein the processor is configured to:

create a filter thickened by a width in a thickness direction determined from a center position of the end portion of the medium detected in an nth photographed image, and when a center position of the end portion of the medium detected in an (n+1)th photographed image falls within the filter, determine that the media are identical, and update the filter to a new filter thickened by the width in the thickness direction determined from the center position of the end portion of the medium of the (n+1)th photographed image.

8. An image forming apparatus comprising:

the medium supply device according to claim 4; and an image forming unit that forms an image on the medium supplied by the medium supply device.

9. The medium supply device according to claim 1, wherein the plurality of lighting units are arranged to be displaced in a direction toward or away from the end portions of the media on the photographing side of the photographing unit.

10. An image forming apparatus comprising:

the medium supply device according to claim 9; and an image forming unit that forms an image on the medium supplied by the medium supply device.

11. The medium supply device according to claim 1, wherein the photographing unit is arranged at a position facing the plurality of media floated and separated by the supply unit, and the lighting unit is arranged at least on an upper side in the up-down direction with respect to the photographing unit.

12. The medium supply device according to claim 11, wherein the plurality of lighting units are arranged on the upper side and a lower side in the up-down direction with respect to the photographing unit.

13. The medium supply device according to claim 11, wherein the photographing unit is arranged at a center portion in the up-down direction facing the plurality of media floated and separated by the supply unit.

14. An image forming apparatus comprising:

the medium supply device according to claim 11; and an image forming unit that forms an image on the medium supplied by the medium supply device.

15. An image forming apparatus comprising:

the medium supply device according to claim 12; and an image forming unit that forms an image on the medium supplied by the medium supply device.

16. An image forming apparatus comprising:

the medium supply device according to claim 13; and an image forming unit that forms an image on the medium supplied by the medium supply device.

17. An image forming apparatus comprising:

the medium supply device according to claim 5; and an image forming unit that forms an image on the medium supplied by the medium supply device.

18. An image forming apparatus comprising:

the medium supply device according to claim 1; and an image forming unit that forms an image on the medium supplied by the medium supply device.

* * * * *